US005224521A

United States Patent [19]

De Jager

[11] Patent Number: 5,224,521

[45] Date of Patent: Jul. 6, 1993

[54] WEFT CATCHER WITH GRIPPING DEVICE

[75] Inventor: Godert De Jager, Uster, Switzerland

[73] Assignee: Sulzer Brothers Limited, Winterthur, Switzerland

[21] Appl. No.: 835,785

[22] Filed: Feb. 14, 1992

[30] Foreign Application Priority Data

Apr. 30, 1991 [CH] Switzerland ..... 01296/91

[51] Int. Cl.[5] ..... D03D 47/30

[52] U.S. Cl. ..... 139/194; 139/302; 139/192

[58] Field of Search ..... 139/194, 302, 370.1, 139/188 R, 192, 435.5; 66/145 S

[56] References Cited

U.S. PATENT DOCUMENTS

| | | | |
|---|---|---|---|
| 3,908,710 | 9/1975 | Van Mullekom | 139/194 |
| 4,570,683 | 2/1986 | Griffith | 139/194 |
| 4,936,353 | 6/1990 | Volland et al. | 139/194 |
| 5,031,422 | 7/1991 | Plath | 66/145 S |

FOREIGN PATENT DOCUMENTS

| | | |
|---|---|---|
| 0342135 | 11/1989 | European Pat. Off. . |
| 3028126 | 2/1981 | Fed. Rep. of Germany . |
| 8302466 | 7/1983 | PCT Int'l Appl. . |
| 651861 | 10/1985 | Switzerland . |

*Primary Examiner*—Andrew M. Falik

*Attorney, Agent, or Firm*—Townsend and Townsend, Khourie and Crew

[57] ABSTRACT

The weft yarn insertion mechanism exhibits at the side of the shed (6) where the weft yarn comes out a yarn holder device (13) for taking over and releasing the end (4'') of the weft yarn, which comprises essentially two gripping parts (16, 17) and one nozzle (18). Preferably the one gripping part (16) is stationary and the other gripping part (17) movable and together they form a wedge shaped gripping gap (24). A blowing nozzle or suction nozzle (18) sucks or blows the end (4'') of the end of the weft yarn into the gripping gap (24) at the moment when the weft insertion is finished. Upon blowing or respectively sucking the end (4'') of the weft yarn into the gripping gap (24) by the impulse from the compressed air from the blowing nozzle (18) or respectively by the impulse from the suction into the suction nozzle, the end (4'') of the weft yarn jams or wedges automatically as soon as that force of tension becomes effective in the weft yarn (4), which is built up in the weft yarn upon being braked by the yarn stopper (11) fitted at the weft insertion side. An actuator mechanism (20) acting upon the movable gripping part (17) releases the end of the weft yarn during or respectively after the beat up of the weft yarn (4') into the weave (10). The weft yarn device enables a considerable reduction in/ the consumption of air and waste of yarn.

17 Claims, 2 Drawing Sheets

WEFT CATCHER WITH GRIPPING DEVICE

BACKGROUND OF THE INVENTION

The present invention is concerned with a mechanism for the insertion of a weft yarn into the shed of a loom, as well as a loom, in particular an airnozzle loom with a profiled reed weft insertion channel. It has a yarn stopper arranged at the weft insertion side for braking the weft yarn after the insertion of a pre selected length of weft yarn into the shed. Further, a yarn holder device is fastened to the sley together with the reed in the region of the side of the shed where the weft yarn comes out for taking over the end of the weft yarn after completion of the weft yarn insertion.

CH 651 861 describes a yarn holder device which at the side of the shed where the weft yarn comes out exhibits a blowing nozzle which is directed into a mixing tube and is fastened to the sley to act transversely to the direction of run of the yarn and deflect the end of the weft yarn, and by which the weft yarn is stretched and held until the subsequent beat up and shed change. Springing back into the shed is thereby avoided. The disadvantages of these blowing and/or sucking nozzles—also known as stretching or gripping nozzles—are in particular the high consumption of air as well as the relatively large waste of yarn.

The reason for the high consumption of air is the relatively long holding time, i.e., the long duration of blowing or sucking for maintaining the flow of air until the weft yarn has been woven in and can no longer spring back into the shed. The relatively large waste of weft yarn arises from the necessity of exerting by the flow of high or low pressure air an adequately strong pull on the weft yarn, which is codetermined essentially by the surface of yarn exposed to the air flow. I.e., the smoother the surface of the yarn or respectively the thinner it is, the greater as a rule must the excess length of yarn and/or the level of the air pressure be chosen.

SUMMARY OF THE INVENTION

The problem to be solved by the invention is to create a yarn holder device which largely independently of the kind of weft yarn being processed at the time, demands excess lengths of yarn which are constant and smaller in comparison with known devices and demands less blowing or suction air.

Generally speaking, the yarn gripping-releasing device of the present invention includes first and second yarn holders positioned on opposite sides of the shed of a loom. The first yarn holder holds the yarn on one side of the shed. A second yarn holder, formed for installation on a loom on the other side of the shed, receives and holds the loose yarn end during beating up. The second yarn holder has opposing gripping parts which form, between them, a wedge-shaped gap sized so that the yarn, when blown into the gap, is engaged by the gripping parts and thereby held by the yarn holder without the need for a closing movement of the gripping parts. The yarn is engaged by the wedge-shaped gripping pad with a short, timed blast of pressurized air or, alternatively, by correspondingly applying a vacuum which pulls the yarn into the gap and holding engagement by the gripping parts.

The wedge shaped yarn-gripping gap of the yarn holder device is essentially in parallel with the direction of run of the weft yarn or the formation of the yarngripping gap by at least one stationary and one movable gripping part with the contours of the two gripping parts facing one another to form together the aforesaid gripping gap. Again, the movable gripping part may be moved by an actuator mechanism from a yarn holding position into a yarn release position, in doing which the edges forming the gripping gap are moved apart. This actuator mechanism is activated at the latest after the beat-up of the weft yarn by means of the reed against the edge of the weave, in order to release the weft yarn at the correct moment before the return of the sley. The actuator mechanism consists, e.g., of a housing lying on the sley and having a piston which is movable in it by compressed air via a diaphragm and one end of which is directed against the movable gripping part.

Another embodiment of an actuator mechanism consists of a fixed or movable part, e.g., a cam or a roller which during the motion of the reed beating up the weft yarn acts upon the movable gripping part, in doing which the yarn gripping gap is widened and the end of the weft yarn is released. The yarn gripping device forming the yarn gripping gap and the blowing or sucking nozzle generating the air jet are arranged at the side of the passageway for the weft yarn, whilst the gripping parts forming the gripping gap are preferably arranged either substantially in line with the beat up plane of the reed and the nozzle opening is arranged next the weave or vice versa, the nozzle opening is arranged substantially in line with the beat-up plane of the reed and the gripping parts forming the gripping gap are arranged next the weave.

The start, duration and pressure of blowing or suction at the nozzle may be automatically adjustable in operation of the loom, in dependence upon the kind of yarn or the colour sequence of the weft. In the case of multicolour looms this adjustment is effected preferably by means of the colour selection and colour control unit. At the side of the shed where the weft yarn comes out, the weft insertion mechanism exhibits a yarn holder device for taking over and releasing the end of the weft yarn, which comprises essentially two gripping parts and one nozzle. Preferably the one gripping part is stationary and the other gripping part movable and together they form a wedge shaped gripping gap. A blowing or sucking nozzle sucks or blows the end of the weft yarn into the gripping gap at the instant when the weft insertion is finished. Upon the end of the weft yarn being blown or sucked into the gripping gap by the impulse of the air under pressure from the blowing nozzle or respectively the impulse of the air being sucked into the suction nozzle, the end of the weft yarn is gripped or wedged automatically as soon as that force of tension in the weft yarn becomes effective, which is built up upon braking by the yarn stopper fitted at the yarn insertion side. An actuator mechanism acting upon the movable gripping part releases the end of the weft yarn during or respectively after the beat-up of the weft yarn into the weave. The weft yarn device of the present invention enables a considerable reduction in the consumption of air and waste of yarn.

The invention is described in greater detail below with the aid of the Figures which show diagrammatically a weft insertion system with grippers and parts of it. Although the examples shown refer throughout to a yarn holder device with blowing nozzles it is naturally directly obvious to one skilled in the art that the end of the weft yarn may also be sucked into the gripping gap by a suction nozzle and what technical and structural measures have to be taken in the case of an embodiment of the invention of that kind.

DESCRIPTION OF THE PREFERRED EMBODIMENTS

Figure 1:
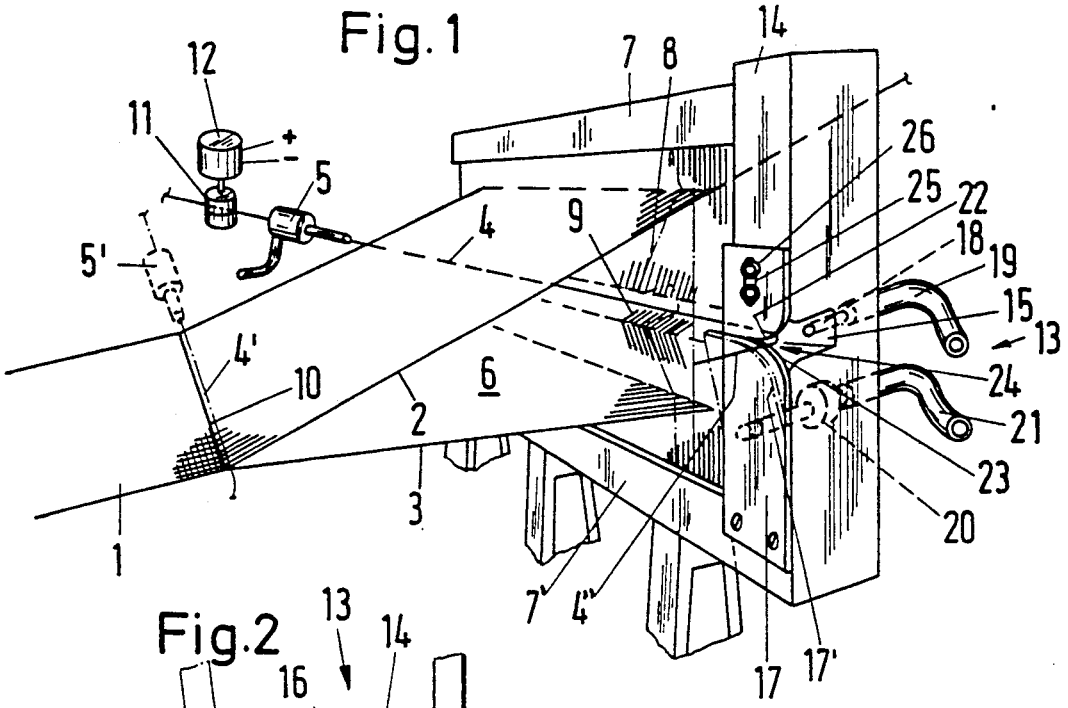
FIG. 1 is a perspective of a yarn holder device in accordance with the invention.

FIG. 1 shows a run of fabric 1 with the warp yarns 2, 3 and weft yarns 4, 4'. The weft insertion system comprises a weft yarn insertion nozzle 5 for introducing a weft yarn 4 into the shed 6, a reed 7 with reed dents 8 profiled to form a guide channel 9 for the weft yarn during insertion as well as for beating up the weft yarn against the edge 10 of the weave after insertion and a yarn stopper 11 with a positioning member 12 for braking a weft yarn at the end of insertion, as well as a yarnholder device 13 in accordance with the invention for securing the weft yarn after completion of the weft yarn insertion. The insertion of the weft yarn is effected, e.g., by means of a main nozzle 5 and possibly additional auxiliary nozzles, not shown here, arranged across the width of the shed. By means which are not shown the yarn holder device 13 is fastened to the sley 7' so that it may be detached or shifted in the direction longitudinal to the reed 7.

The yarn holder device 13 comprises essentially a carrier 14 which exhibits a groove 15 in continuation of the dent channel 9. There is further on the carrier 14 a stationary gripping part 16, a movable gripping part 17, a blowing nozzle 18 with a compressed air connection 19 and an actuator mechanism 20 with a compressed air connection 21. Together the bottom edge 22 of the stationary gripping part 16 and the top edge 23 of the movable gripping part 17 form a wedge shaped gripping gap 24. By shifting the gripping part 16 via, e.g., the oblong hole 25 after loosening the fixing screws 26, the position of the bottom edge 22 may be altered with respect to the top edge 23 of the bottom gripping part, whereby there exists a possibility of setting for receiving yarns of different numbers, i.e., different thicknesses. The open position of the lower gripping part 17' is shown in a dash dot line.

FIG. 1 shows the instant of completion of a weft insertion with the yarn stopper 11 in the closed position. The blowing nozzle 18 has deflected the end 4'' of the weft yarn out of the flight path by a short blowing impulse and blown it into the gripping gap 24. In this final phase of the weft insertion, upon the weft yarn being braked by the yarn gripper arranged on the insertion side, the weft yarn is stretched and gripped. Before the yarn can bounce back from this gripping, the end 4'' of the yarn, as described above, must be deflected by the blowing nozzle 18 into the gripping gap 24 and there secured. Already in the starting phase of pulling back, the end of the yarn is gripped or wedged in the gripping gap 24, before the gripped and stretched yarn can spring back into the still open shed. The blowing impulse for the deflection of the end of the yarn is advantageously effected at a time matched to the actuation of the yarn gripper 11.

Figure 2:
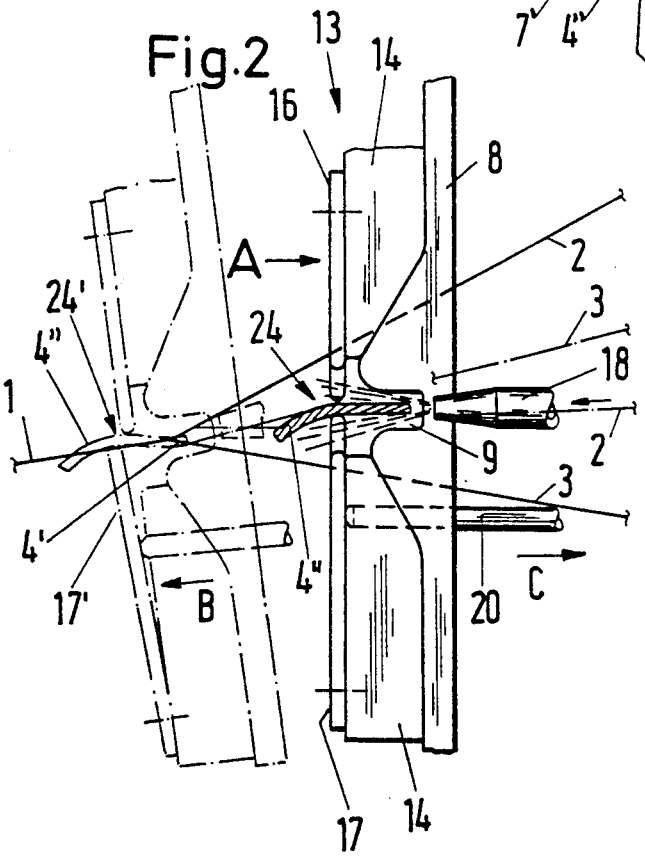
FIG. 2 is a side elevation of the essential operational parts of the device in two different operational positions.

FIG. 2 shows the essential parts of the yarn holder device 13 in side elevation, looking in the direction of the open shed, as seen from the side where the weft yarn leaves. The device is shown in solid line in the position towards the rear away from the weave, that is, at the instant of deflection of the end 4'' of the weft yarn into the yarn gripping gap 24 by the blowing nozzle 18. The actuator mechanism 20 is in a retracted non effective position.

The mechanism is shown in dash-dot line in the beat up position. The warp yarns 2, 3 have been crossed over by a shed changing mechanism (not shown), i.e., heald frames, and by means of the actuator mechanism 20 being moved in the direction of the arrow B the lower gripping part 17 has been moved into the open position 17' for releasing the end 4'' of the weft yarn. In this weft beat up position, by the crossing of the warp yarns the weft yarn 4' has now been sufficiently secured in its stretched position so that release of the end 4'' of the weft yarn may be effected. The sley 7' with the yarn holder device fastened to it, now returns to the starting position remote from the weave, whilst the actuator mechanism 20 is moved in the direction of the arrow C and the springing or sprung lower gripping part 17 arrives back at the yarn takeover position on the carrier 14. Now the next weft yarn may be gripped.

Figure 3:
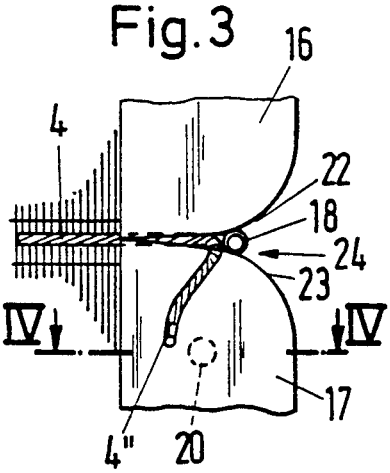
FIG. 3 is a partial elevation in accordance with FIG. 2, considered in the direction of the arrow A.

FIG. 3 shows part of the yarn holder device 13 of FIG. 2 considered in the direction A. In particular the position with respect to one another is shown, on the one hand of the gripping parts 16, 17 which are important for the operation of the yarn holder device, and the blowing nozzle 18 of the yarn holder device 13, and on the other hand of the actuator mechanism 20.

Figure 4:
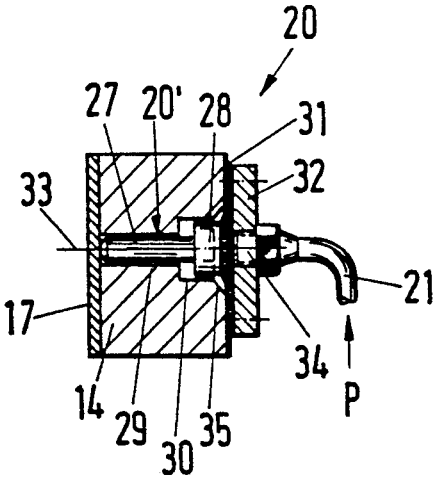
FIG. 4 is a section along the line IV—IV in FIG. 3, of an actuator mechanism of the yarn holder device in accordance with the invention.

FIG. 4 shows a cross section along the line IV—IV of the yarn-holder device in FIG. 3, with essential parts of the actuator mechanism 20 represented. These are a piston 20' with a shank portion 27 of smaller diameter and a head portion 28 of larger diameter. The piston 20' is guided to be able to shift axially in corresponding bores 29, 30 in the carrier 14. The smaller diameter end of the piston is directed against the gripping part 17 and the larger diameter end is directed against the diaphragm 31. The diaphragm 31 together with the plate 32 is fastened to the carrier 14. In line with the centerline 33 of the piston 20', in the center of the plate 32 is the compressed air connection 21, the outlet 34 from which opens into the space bounded by the diaphragm 31. In the region between the head portion 28 of the piston and the diaphragm the carrier 14 is provided with a conical depression 35.

The actuator mechanism 20 functions as follows:

After a weft yarn has been inserted in the shed, the end of the yarn has been seized by the yarn holder device 13, the weft yarn has been beaten up against the edge of the weave by the reed and, at the same time, the upper and lower warp threads have crossed over, the diaphragm 31 is acted upon by compressed air via the compressed air connection 21—indicated by the arrow P. Via the movement of the diaphragm 31 against the depression 35 the piston is thereupon shifted axially and presses by the end of the shank portion against the gripping part 17. The gripping gap of the yarn holder device 13 is thereby opened or widened and releases the yarn end 4" as shown in dash-dot line in FIG. 2.

Figure 5:
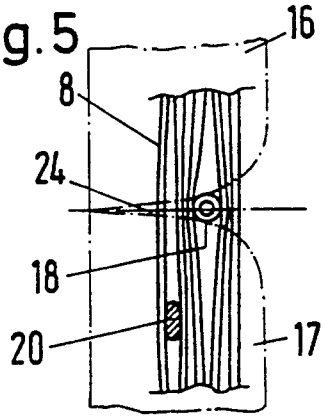
FIG. 5 is an arrangement of a blowing nozzle and actuator mechanism with respect to the reed and the yarn holder device.

FIG. 5 illustrates diagrammatically a yarn holder device in which the blowing nozzle 18 and the actuator mechanism 20 dip into respective dent bars between two reed dents 8. This kind of execution of the yarn holder device has the advantage that it may be used in many ways independently of the reed drawing-in width. This solution merely presupposes an appropriate pitch of the reed or thickness of the reed dents as well as an appropriate dimension of the nozzle 18 and of the actuator mechanism 20. In the representation according to FIG. 5 the position of the gripping parts 16, 17 is indicated in dash-dot line.

Figure 6:
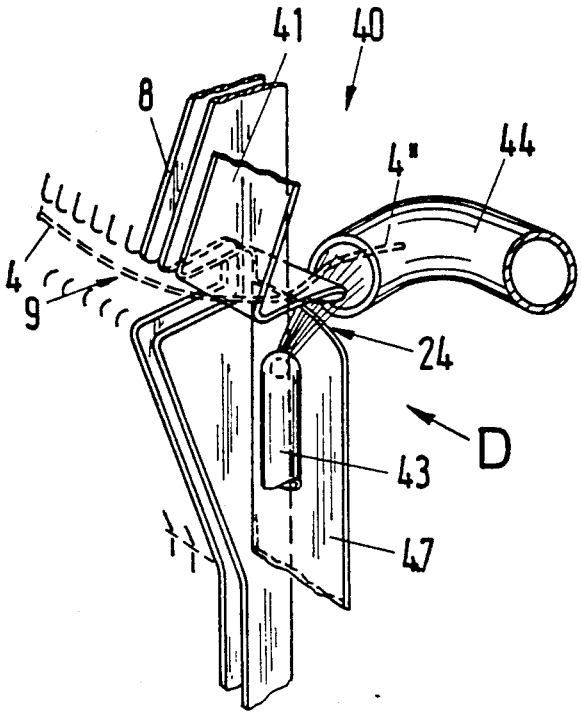
FIG. 6 is a perspective of a modified kind of execution of the yarn holder device in accordance with the invention.
Figure 7:
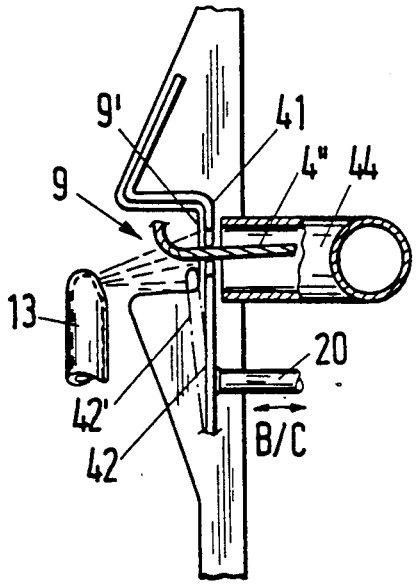
FIG. 7 is an elevation in the direction D of the kind of execution according to FIG. 6.

FIGS. 6 and 7 show a modified yarn holder device 40 in which the gripping parts 41, 42 forming the gripping gap 24 lie substantially in one common plane with the bottom 9' of the yarn guide channel and the blowing nozzle 43 blows in the direction away from the weave in order to bring the yarn end 4" into the position for holding by the yarn-holder device 40.

The upper stationary gripping part 41 may, e.g., be produced as a sheetmetal part and shaped to match the dent profile in order that the end of the weft yarn may be deflected into the wedge gap by the air jet from the blowing nozzle 43 with as little disturbance as possible. A curved tube 44 is preferably arranged—in the direction of the warp—behind the gripping gap and likewise fastened to the sley 7'. Such a tube serves to carry away bits of broken weft yarn. In such a tube, not shown here, weft yarn monitors may be arranged which, e.g., in the case of a wrong length of weft yarn or a break in the weft yarn emit a signal to the loom control to bring it about, for example, that the length of weft yarn is altered or in the case of a weft yarn breakage stops the loom. In FIG. 7 the actuator mechanism 20 is shown again in dash-dot line, with the lower gripping part 42' in the open position.

Figure 8:
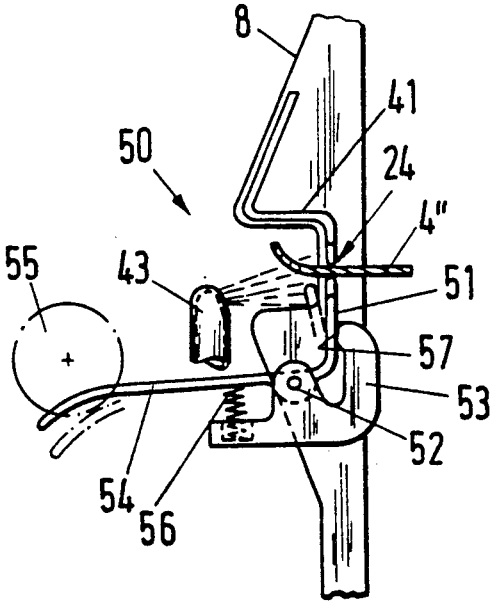
FIG. 8 is a perspective of a further kind of execution.

FIG. 8 finally shows a further variant upon a yarn-holder device 50 which is fastened to the sley. As distinct from the yarn holder devices described above, here the lower gripping part 51 is provided with a pivot bearing 52 which is supported on the reed by a carrier 53. At the side of the pivot bearing 52 remote from the sley the gripping part is provided with a lever 54. During weft beat up by the reed 7 this lever extension 54 is deflected by the cam 55. A spring 56 brings about the return of the gripping part 51 against the stop 57 on the carrier 53 as soon as the reed returns to the open shed position.

Although in the drawings the jet from the nozzle is represented largely as almost parallel with the run of the weft yarns, the gripping gap as practically parallel with the run of the weft yarns and the gripping parts as approximtely perpendicular to the family of weft yarns, the invention naturally does not remain restricted to this advantageous arrangement of the parts of the yarn holder device. Thus it is conceivable, for example, to arrange the suction or blowing jets from the nozzle but also the gripping gap and gripping parts at an angle to the weft direction and/or to the warp direction.

What is claimed is:

1. In a loom forming a shed and including a yarn holder device (11) on a side of the shed (6) and a weft yarn gripping mechanism on another side of the shed, the improvement to the gripping mechanism comprising means forming a wedge-shaped yarn gripping gap (24) and a nozzle (18) for pneumatically forcing an end of a weft yarn (4) into the yarn gripping gap (24) to thereby hold the yarn with the wedge-shaped yarn gripping gap forming means.

2. A loom as in claim 1, characterized in that the wedge-shaped yarn gripping gap (24) of the yarn holder device (13) is aligned essentially in parallel with the weft yarn (4).

3. A loom as in claim 1, wherein the means for forming the yarn gripping gap (24) comprises at least one stationary gripping part (16) and at least one movable gripping part (17) for releasing yarn held in the gripping gap.

4. A loom as in claim 3, including an actuator mechanism (20) acting on the movable gripping part (17) for moving it out of a yarn holding position into a yarn releasing portion and back again.

5. A loom as in claim 4, wherein the actuator mechanism includes an actuator member (20') inserted in holes (29, 30, 35) in a carrier (14) fastened to a sley (7) of the loom, and a diaphragm (31) movable by compressed air and acting upon one end (28) of the actuator member (20'), an other end (27) of the actuator member actuating the movable gripping part (17).

6. A loom as in claim 4, wherein the loom has a beating up reed, and wherein the actuator mechanism includes a part (55) acting upon the movable gripping part (51, 52, 54) in such a way that the wedge-shaped yarn gripping gap (24) is enlarged and hence the weft yarn is released during the reed beating up movement.

7. A loom as in claim 3, characterized in that the wedge-shaped yarn gripping gap (24) of the yarn holder device (13) and the nozzle (18) are for placement at a side of a weft insertion channel (9) of the loom, and wherein the gripping parts (16, 17) forming the wedge-shaped gripping gap (24) are formed for substantially in line positioning with a reed beat up plane of the loom and an opening of the nozzle (18) is located at a distance from it on a side next a weave.

8. A loom as in claim 3, characterized in that the wedge-shaped yarn gripping gap (24) of the yarn holder device (13) and the nozzle (18) are for placement at a side of a weft insertion channel (9) of the loom, and wherein an opening of the nozzle (18) is formed for substantially in line positioning with a beat up plane of the loom and the gripping parts (16, 17) forming the wedge-shaped gripping gap (24) are adapted to be located at a distance from it on the side next the weave.

9. A loom as in claim 1, including means for automatically regulating the beginning and duration of a pressure change at the nozzle (18).

10. A loom as in claim 1 wherein the nozzle is adapted to apply a pressurized gas to the weft yarn to blow it into the yarn gripping gap.

11. A loom as in claim 1 wherein the nozzle is adapted to subject the weft yarn to a vacuum to force it into the gripping gap.

12. In a loom including a movable reed for beating up weft yarn against an edge of a weave, a shed extending across a width of the weave and a pneumatic weft yarn gripping mechanism, the improvement to the gripping mechanism comprising a first yarn holder on one side of the shed and a second yarn holder on another side of the shed, the second holder comprising first and second gripping means defining therebetween a wedge-shaped gripping gap tapering from a transverse gap width greater than a thickness of the weft yarn to a transverse gap width less than a thickness of the weft yarn, so that the weft yarn can become wedged between and held by the first and second gripping means; pneumatic means positioned relative to the first and second gripping means for pneumatically forcing the weft yarn into the wedge-shaped gap and engagement by the first and second gripping means to thereby hold the weft yarn with the second holder; and means for maintaining the first and second gripping means fixed with respect to each other in an original position while the pneumatic means forces the weft yarn into the wedge-shaped gap and until after the weft yarn is held by the second holder.

13. A loom according to claim 12 including an actuator mechanism operatively coupled with at least one of the first and second gripping means for moving the gripping means relative to each other out of the original position for releasing the weft yarn from its holding engagement in the wedge-shaped gripping gap to thereby release the weft yarn from the second yarn holder.

14. A loom according to claim 13 wherein the actuator mechanism includes means for moving the at least one of the gripping means back into the original position and wherein the pneumatic means includes means for timing its operation so that it pneumatically moves the weft yarn into the wedge-shaped gripping gap after the means for moving has returned the at least one gripping means to the original position.

15. A loom for making a weave by forming a shed defined by first and second sets of angularly inclined warp yarns; means for transferring weft yarns from one side of the shed to the other side thereof; first means at the one side of the shed for holding the weft yarn during beating up; second means on the other side of the shed for holding the weft yarn during beating up; and a reed for beating up the weft yarn against an edge of the weave, the second means comprising first and second gripping means defining therebetween a wedge-shaped gripping gap tapering from a transverse gap width greater than a thickness of the weft yarn to a transverse gap width less than a thickness of the weft yarn, so that the weft yarn can become wedged and held between the first and second gripping means; pneumatic means positioned relative to the first and second gripping means for pneumatically forcing the weft yarn into the wedge-shaped gap and engagement by the first and second gripping means to thereby hold the weft yarn with the second means; and means for maintaining the first and second gripping means fixed with respect to each other while the pneumatic means forces the weft yarn into the wedge-shaped gap and until after the weft yarn is held by the second means.

16. A mechanism according to claim 15 including an actuator mechanism operatively coupled with at least one of the first and second gripping means for moving the gripping means relative to each other for releasing the weft yarn from its holding engagement in the wedge-shaped gripping gap to thereby release the weft yarn from the second means.

17. A mechanism according to claim 16 wherein the actuator mechanism includes means for returning the at least one of the gripping means to its position in which the weft yarn can be held in the wedge-shaped gripping gap, and wherein the pneumatic means includes means for timing its operation so that it pneumatically moves the weft yarn into the wedge-shaped gripping gap after the means for returning has returned the at least one gripping means to said position.

* * * * *